US007430980B2

(12) United States Patent
Fishburn

(10) Patent No.: US 7,430,980 B2
(45) **Date of Patent: *Oct. 7, 2008**

(54) BIMINI TOP MAIN BOW CONNECTOR

(75) Inventor: Bradley R. Fishburn, Nappanee, IN (US)

(73) Assignee: Bennington Marine LLC, Elkhart, IN (US)

( * ) Notice: Subject to any disclaimer, the term of this patent is extended or adjusted under 35 U.S.C. 154(b) by 98 days.

This patent is subject to a terminal disclaimer.

(21) Appl. No.: 11/497,216

(22) Filed: Aug. 1, 2006

(65) Prior Publication Data

US 2007/0295263 A1 Dec. 27, 2007

Related U.S. Application Data

(63) Continuation of application No. 10/976,437, filed on Oct. 29, 2004, now Pat. No. 7,107,926.

(51) Int. Cl.
*B63B 17/00* (2006.01)

(52) U.S. Cl. ..... 114/361

(58) Field of Classification Search ..... 114/361, 114/364; 135/88.01, 88.02, 88.03, 96; 292/338; 403/322.3, 325

See application file for complete search history.

(56) References Cited

U.S. PATENT DOCUMENTS

| | | | | |
|---|---|---|---|---|
| 2,821,989 | A | 2/1958 | Shepard | |
| 3,685,061 | A | 8/1972 | Wray | |
| 4,404,714 | A | 9/1983 | Duran | |
| 4,588,220 | A * | 5/1986 | Matsui et al. | 292/338 |
| 4,799,444 | A | 1/1989 | Lisowski | |
| 5,303,667 | A | 4/1994 | Zirkelbach et al. | |
| 5,367,977 | A | 11/1994 | Ellis et al. | |
| 5,413,063 | A | 5/1995 | King | |
| 5,458,079 | A | 10/1995 | Matthews et al. | |
| 5,464,301 | A | 11/1995 | Kramer | |
| 5,520,139 | A | 5/1996 | King et al. | |
| 5,697,320 | A | 12/1997 | Murray | |
| 5,706,752 | A * | 1/1998 | Menne et al. | 114/361 |
| 5,803,104 | A | 9/1998 | Pollen | |
| 5,904,114 | A | 5/1999 | Wright | |
| 5,931,114 | A | 8/1999 | Bartholomew | |
| 6,006,692 | A | 12/1999 | Szukhent, Jr. | |
| 6,349,666 | B1 | 2/2002 | Hastings | |
| 6,672,241 | B2 * | 1/2004 | Warfel et al. | 114/361 |
| 6,820,569 | B2 * | 11/2004 | Warfel et al. | 114/361 |
| 7,107,926 | B2 * | 9/2006 | Fishburn | 114/361 |

* cited by examiner

*Primary Examiner*—Lars A Olson
(74) *Attorney, Agent, or Firm*—Baker & Daniels LLP

(57) ABSTRACT

A collapsible frame for a cloth or canvas-like top for a boat, having latching members which retain the collapsible frame to a plurality of mounting brackets secured to the boat frame. An over the center rotating latching member allows the collapsible frame to be quickly connected to the boat when not in use. The rotating latching member does not require the usage of removable parts that may be lost or misplaced. The rotating latching member also couples to an insert including an arcuate surface complementary to the rotating latch member. The insert includes slots that may be used to organize wires connected to the bimini top.

25 Claims, 11 Drawing Sheets

BIMINI TOP MAIN BOW CONNECTOR

BACKGROUND OF THE INVENTION

1. Field of the Invention

The present invention relates to a collapsible frame including a cloth or a canvas-like top and fasteners for use with a watercraft. More particularly, the present invention pertains to a collapsible frame for a bimini sun top in use on a pontoon boat.

2. Description of Prior Art

Collapsible boat frames including a canvas-like top protecting the occupants of the boat from inclement weather and providing shade from the sun are well known in the art. Such a collapsible frame is shown in our U.S. Pat. No. 6,672,241. Often times, these frames are made from a light but strong material, such as aluminum, in order to add as little weight to the boat as possible, but still provide sufficient strength to ensure that the top does not buckle or collapse in strong winds or heavy seas. Typically, these frames are designed to be first retained in a closed position, providing very little to no cover over the occupants of the boat, while occupying very little deck or storage space. Generally, this is accomplished by supporting the frame along the sides of the boat. When protection is desired, the frame may be opened into a second position, stretching the canvas covering, over a substantial portion of the deck. Typically, these frames may also be arranged in a third position for long-term storage or land transport of the boat. This third position is a more secure location designed to reduce drag on the cover, thereby increasing the life of the canvas, and to ensure the cover is maintained at a height level below low tree branches and power lines, as the boat rolls upon the trailer.

One of the major limitations of the collapsible bimini tops and frames known in the prior art is the inclusion of removable retaining members, which may be lost or misplaced when the collapsible frame is being moved from one of the above-described positions to another, or can simply be lost due to vibration as is common to fasteners. U.S. Pat. No. 5,706,752 granted to Menne, Jr., et al., discloses a bimini sun top frame for a pontoon boat. When in the open position, the frame disclosed therein is attached to the rails of the pontoon boat, in three different positions, by either stainless steel screws or bolts, which must be removed if the position of the frame is to change. These stainless steel pieces may be easily misplaced or lost over the side of the boat becoming unrecoverable and thereby requiring replacement of the lost articles. Further, the use of screws and bolts require the use of tools, such as screw drivers, in order to free the frame from its connection to the deck rails, and allowing rearrangement.

U.S. Pat. No. 5,803,104 granted to Pollen discloses a bimini cover for a deck of a watercraft. This cover, when in the open position, is in contact with the frame rails of the pontoon boat in two positions. In order to rearrange the positioning, a pin must be removed and set aside and a spring/pin combination must be depressed. This represents a complicated means for changing the positioning of the cover, during which an opportunity for misplacement of the pin presents itself, thereby rendering the bimini top useless until a replacement pin can be located.

Another known shortcoming to the existing covers is that when in the secured position for towing, the collapsed frame bounces during transport, and often times mars the covering, the seat covers on which it rests, or other articles are dented or scratched due to the vibrating frame.

SUMMARY OF THE INVENTION

It is an object of the invention to provide a more easily operable frame for a cover top of a boat or similar article. It is a further object of the present invention to employ a collapsible frame for use on a watercraft, which may be arranged in a storage position, a closed transport position, and an open position providing protection to the occupants of the watercraft. Further, rearrangement of the frame may be accomplished without need for removable parts, such as screws, bolts and the like.

It is another object of the invention to ensure that when arranged in the storage position, the frame and cover remain secure and do not bounce or damage either the side frame rails or the deck of the boat.

These and other objects of the invention are achieved by providing a bimini top frame including latching members, thereby allowing the frame to be fixed to a bracket, permanently mounted to either the deck of the boat or the top frame rails of the pontoon boat. The latching members envelop smooth pins joined to the brackets with the raised lip portion of the latching member ensuring the latching members stay engaged with the pins, thereby securing the frame to the frame rails of the pontoon boat. These latching members may be disengaged from the bracket assembly through the application of a light force upon a lever arm causing movement of the raised lip. As such, rearrangement of the frame is accomplished without a need for tools or removable components.

The frame includes a plurality of ribs with grooves that complement a winged portion of the latching member. This winged portion of the latching member includes a pair of extended walls having ribs. These walls are flexible but also sufficiently resilient, such that this portion of the latching member may be joined with any portion of the frame having grooves on the surface. The wings of the latching member are able to flex a sufficient distance such that the ribs located on the inner surface of the walls snap into the grooves of the frame. Although the wings are sufficiently resilient ensuring the latching member will stay attached to the frame during normal use, the side walls of the latching member have adequate flexibility such that a normal lifting force applied by a user will disengage the latching member from the frame. Due to the use of these latching members, no removable pins, bolts, screws or the like are needed to employ the bimini top of the present invention. This eliminates the requirement of employing tools to rearrange the top from one position to another and eliminates the possibility of misplacing removable components when switching the top from one position to another.

It is also an object of this invention to provide a bimini top which rests above the frame rails during transport, ensuring the top does not come into contact with the frame rails and preventing damage to both the top and the frame rails. This is accomplished by including a smaller frame portion with two latching members having both the notched portion and the flexible wings. This smaller frame provides support to the frame when arranged in the storage position by latching onto a pin/bracket assembly attached to the frame rails above the deck so that the bimini frame remains located just above the frame rails.

In an alternative embodiment of the present invention, a combination of a latching member and a bracket insert combine to provide an over-the-center connection of the bimini top to the boat. The rotating latching member includes a pivot point offset from the position the member attaches to the bimini top frame. The offset configuration allows the latching member to be secured to brackets of the boat by rotating the latching member beyond a specific point due to interference with the insert.

In one embodiment, the insert includes longitudinal slots extending therethrough. The slots allow for the easy organization of wires, such as power wires for lights attached to the bimini top.

Further scope of the applicability of the present invention will become apparent from the detailed description contained herein. However, it should be understood that the detailed description and specific example, while indicating one embodiment of the invention, are given by way of illustration only, since various changes and modifications within the spirit and scope of the invention will become apparent to those skilled in the art, from this detailed description.

BRIEF DESCRIPTION OF THE DRAWINGS

These and other features of the invention will become more apparent and the present invention will be better understood upon consideration of the following description and the accompanying drawings wherein.

DETAILED DESCRIPTION OF THE EMBODIMENTS OF THE INVENTION

The embodiment of the invention described herein is not intended to be exhaustive, nor to limit the invention to the precise forms disclosed. Rather, the embodiment selected for description has been chosen to enable one skilled in the art to practice the invention.

Figure 1:
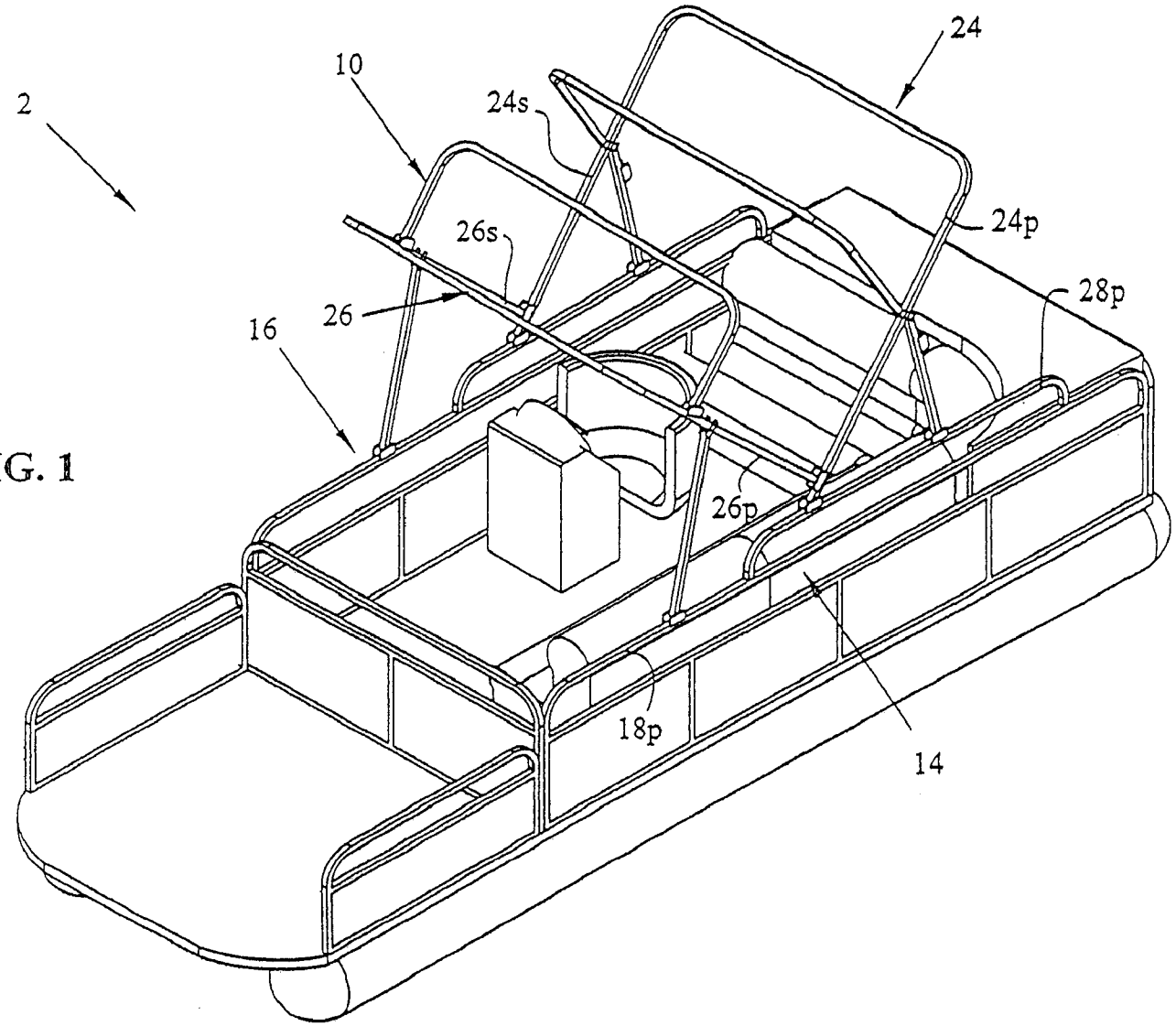
FIG. 1 is a perspective view of a boat including the collapsible boat frame of the present invention situated in the open position.

Referring in detail to the drawings and with particular reference to FIG. 1, a watercraft 2 is depicted, and in particular a pontoon boat, where the pontoon boat includes a collapsible frame 10 in an open position capable of supporting a cover (not shown) to shield a portion of a watercraft from above. The cover may be made from any type of material known in the art, such as a cloth or canvas. Additionally, it is generally preferred that the cover be resistant to water so as to protect boat occupants from inclement weather. Further, it is also desired that the cover be made from a material which does not greatly expand or contract in the presence of sunlight, as often these covers are employed by the occupants of the watercraft 2 to provide shade.

Displayed in FIG. 1 and throughout, the watercraft 2 is shown as a pontoon boat, having a port side frame generally indicated by numeral 14, and a starboard side frame generally indicated by numeral 16. Although a pontoon boat is displayed throughout the figures as the support for frame 10, it should be readily apparent to one possessing ordinary skill in the art that this frame may be adapted to any type of watercraft capable of providing an area sufficient to support the bracket assemblies described herein, such as a deck boat, a speed boat or a fishing boat. Although in the embodiment shown herein, the collapsible frame 10 mounts to the frame rails 14, 16 in a manner described below, it should be noted that the frame rails 14, 16 are not necessary to employ the collapsible frame 10 described herein, but rather, the frame may be mounted directly to either the deck portion or side frames of any boat.

Figure 2:
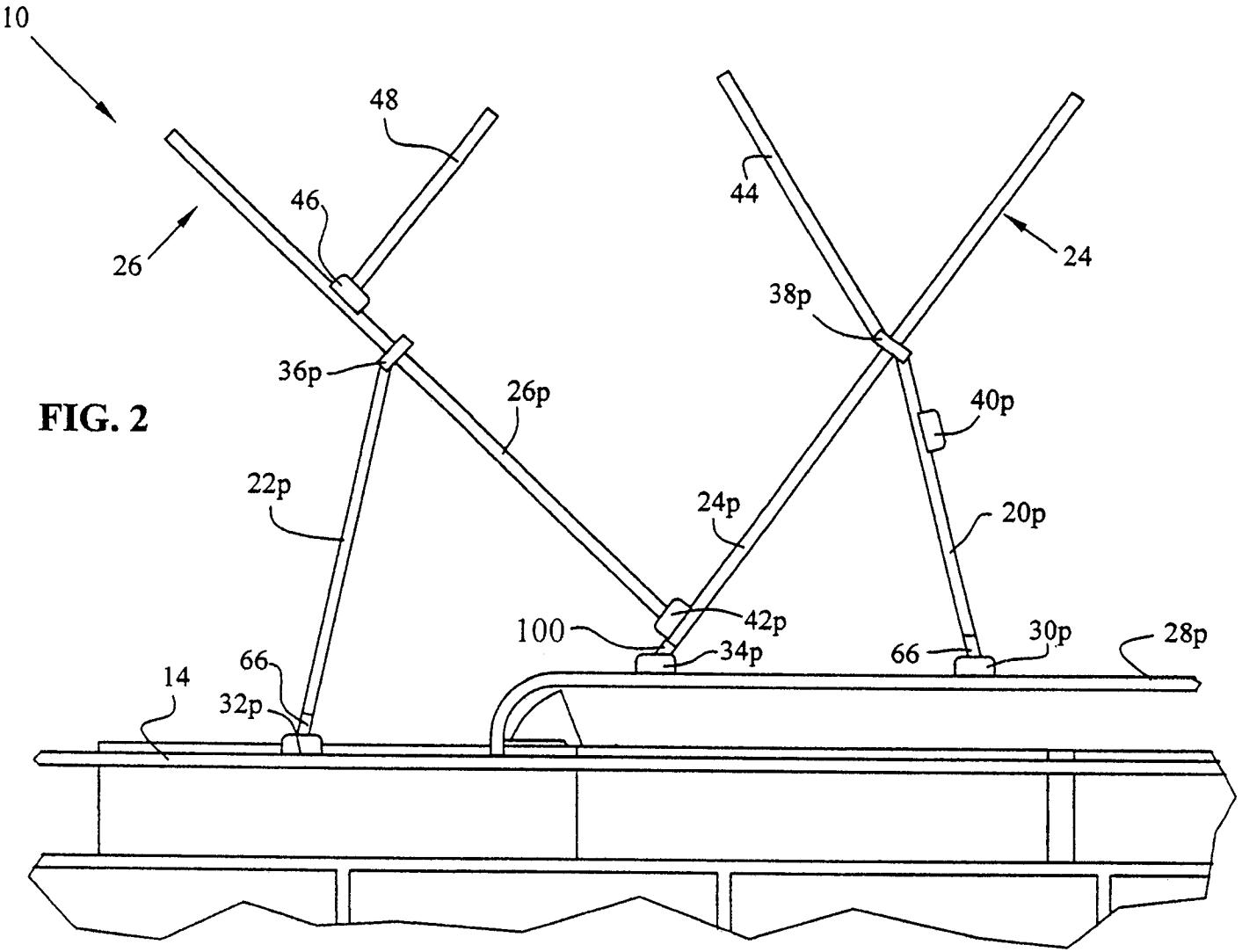
FIG. 2 is a port side view of the collapsible frame shown in FIG. 1.

Referring now to FIG. 2, a port side view of the frame 10 is now shown. The frame 10 attaches to the pontoon boat 2 on both the port side and the starboard side, but for ease of description, only the construction and attachment of the frame 10 to the port side frame of the boat 2 will be described. As would be readily apparent to one possessing ordinary skill in the art, attachment of the frame 10 to the starboard side frame rail 16 may proceed in a similar manner, and with similar components. However, to facilitate this description, while all components are identified by a reference numeral, some reference numerals include a port side (p) and a starboard side (s) designation indicating which side of boat 2 is being referred to and to which side the component is being affixed.

Referring still to FIG. 2, port side frame rail 14 is generally comprised of a first frame rail 18*p* and a raised frame rail 28*p*. The raised frame rail 28*p* may be permanently affixed to the port side frame rail 14 via any manner capable of providing support to the frame that is well known in the art.

With respect now to FIGS. 1 and 2, the components of the frame 10 will be described in greater detail. The frame 10 is comprised of a U-shaped main frame section 24 having leg portions 24*p* and 24*s*, where leg portions 24*p* and 24*s* are rotatably attached to the raised rail 28*p*, by way of a bracket 34*p*, having a threaded wheel 49. A secondary U-shaped frame 26 is rotatably fixed to main frame section 24 by bracket 42*p*. Tensioning frame members 44 and 48 are attached to frame portions 24 and 26, respectively, and are also U-shaped, as shown in FIG. 1. Frame member 44 is fixed to frame member 24 by way of double-sided bracket 38*p*, and frame member 48 is fixed by way of bracket 46. Support frame rails 20*p* and 22*p* are rotatably attached to frame rails 24*p* and 26*p*, by way of brackets 38*p* and 36*p*, respectively. The support frame members 20*p* and 22*p* are latchably attached to respective brackets 30*p* and 32*p*, by way of latch members 66, which will be more fully described herein.

Figure 3B:
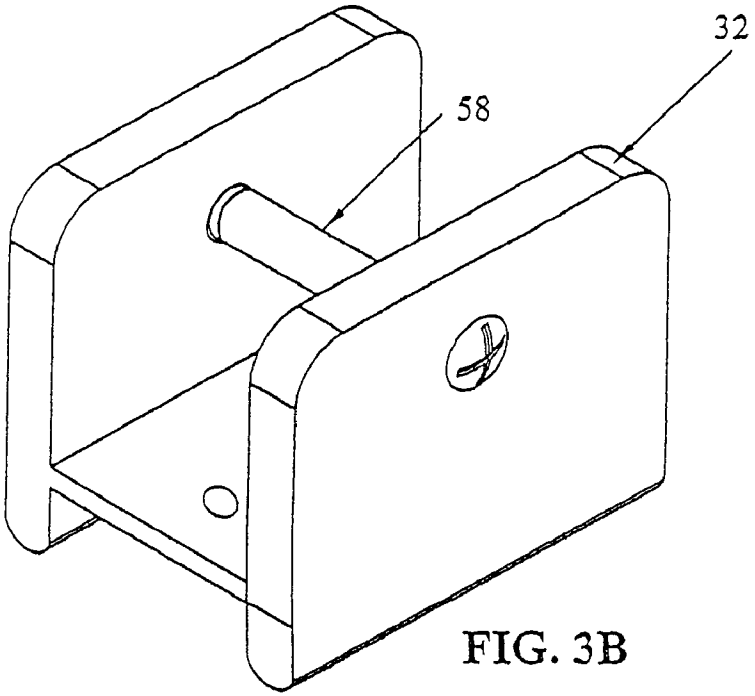
FIG. 3B is a perspective view of the bracket assembly of FIG. 3A, now in the assembled position.
Figure 3A:
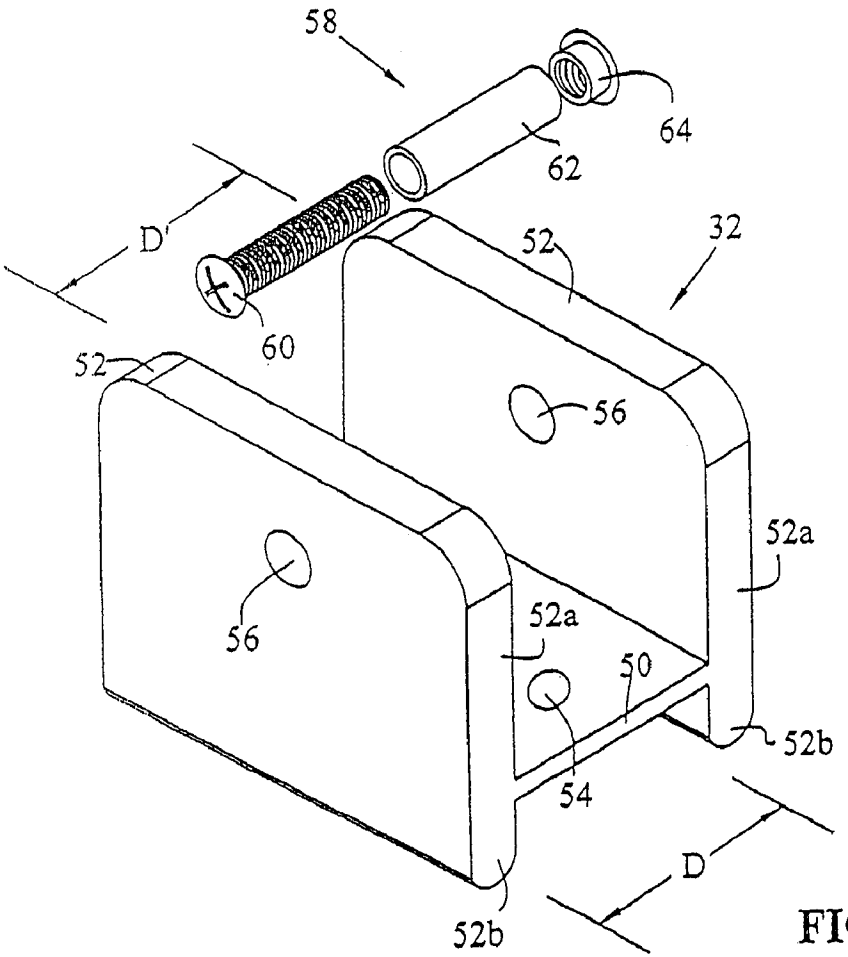
FIG. 3A is perspective view of a bracket utilized in the present invention for securing the collapsible frame to a watercraft, with the fastener assembly shown poised for receipt.

Referring now to FIGS. 2, 3A and 3B, frame bracket 32 will be described in greater detail. Two additional brackets, which are identical to that shown in FIG. 3A, are also attached to the frame 10; a rearward stern frame bracket 30*p*, and bracket 40*p* attached to support rail 20*p*. These brackets, much like their counterparts located on the starboard side, all have the same structure with the use of the different numerals being used only to indicate the relative position of the brackets on the pontoon boat 2. Therefore, with reference to FIGS. 3A and 3B, the bracket will be referred to generally by reference numeral 32, it being understood that this same structure applies to brackets 30*p* and 40*p*.

Referring first to FIG. 3A, bracket 32 includes a base 50, a pair of upright walls 52, a plurality of mounting holes 54, and a pair of bolt holes 56. The base 50 and the upright walls 52 may be comprised of aluminum, or any material having similar strength properties. Obviously, aluminum is preferred due to its light weight and resistance to corrosion. The base 50 is a planar section extending between the two parallel upright walls 52, which are arranged in a perpendicular manner such that a 90° angle is formed between each of the walls 52 and the base 50. As shown in FIG. 3A, walls 52 extend above and below base portion 50, so as to form wall portions 52A and 52B. The distance between the parallel walls 52 may vary as is necessary for the individual application. For example, the distance separating the parallel walls 52B below the base 50 is generally indicated by the letter "D." This portion of the bracket 32 generally is mounted to a portion of the boat 2 whether that portion is a raised frame, as in the present application, or a side member of the boat 2. In the preferred embodiment, the bracket 32 is mounted to the rails forming the frames 14, 16 and are therefore appropriately dimensional, as described below.

As would be obvious to one skilled in the art, this portion of the bracket should be manufactured with a distance D approximately equal to the width of the mating piece, such that the bracket securely holds onto the mating piece with lateral movement of the bracket being very limited. Likewise, the distance between the parallel walls 52A above the base 50 is indicated by D'. This portion of the bracket 50 receives various frame rails from the frame 10. As such, the upper distance D' should approximate the width of the frame rails in order to limit the lateral movement of the frame rails within the bracket, but at the same time, allow for their rotation. In the present application, all of the frame rails have substantially the same width, such that D' in all the brackets used in this embodiment is equal. Further, all the portions of the boat 18 to which the bracket 50 will be mounted are equivalent in width, meaning that the distance D for each bracket is substantially equal. Finally, preferably all frame rails used to form the frame 10, and frames 14 and 16 utilize the same rail size and therefore for all brackets 32*p*, 30*p* and 40*p*, D=D'. Consequently, the brackets used in this embodiment are universal and may be located at any one of the various positions described above.

Referring still to FIG. 3A, the mounting holes 54 allow the bracket to be affixed to either the port side frame rail 14 or the raised frame rail 28*p* via a screw or a bolt (not shown). The bolts extend first through the mounting hole and then through the rail to which the bracket 32 is being mounted, and then in the case of a bolt, the end extending through the bracket 32 and the rail is rotatably inserted into a nut (not shown) in a manner well known, so as to secure the bracket 32 to the rail. The manner of securing the bracket 32 to the frame rail 18*p*, 20*p*, 28*p*, 28*s* allows removal of the bracket 32 if desired. However, as should be apparent to one skilled in the art, if it is desired to permanently secure the bracket 32 to the frame rail 18*p*, 20*p*, 14, 28*p*, 28*s*, the bracket may be welded directly to the frame rail 18*p*, 20*p*, 14, 28*p*, 28*s*, usurping the need for a mounting bolt.

As stated above, each of the upright walls 52 includes a bolt hole 56, and the bolt holes 56 of the two upright walls 52 are located such that a longitudinal axis (not shown) parallel to the base 50 extends through the center of the bolt holes 56. This allows a bolt 58 to be inserted through the bolt holes 56 extending therebetween. The bolt 58 shown in FIG. 3A is comprised of three components: a threaded portion 60, a sleeve 62, and an internally threaded end cap 64, all manufactured from a stainless steel material or the like, in an effort to prevent oxidation of the bolt 58 as it comes into contact with water. The threaded portion 60 is substantially similar to any standard stainless steel screw having sufficient size to satisfy the needs of this application. The sleeve 62 is a hollow tube, smooth on both the inner surface and the outer surface, and having a diameter of sufficient size to allow the threaded portion 60 to be inserted therethrough. The threaded end cap 64 includes a smooth outer surface with an outer diameter approximately equal to the outer diameter of the sleeve 62, and an inner surface having threads of the same gauge as the threaded portion 60, so as to allow the threaded portion 60 to be threadably inserted into the end cap 64. Both the threaded portion 60 and the end cap 64 include a means to allow rotation, such as the familiar Phillips slot shape, which allows rotation by a standard Phillips screw driver (not shown) or a slit of sufficient size allowing receipt of a standard flat head screw driver.

In order to secure the bolt 58 to bracket 50, the sleeve 62 must first be supported between the upright walls 52, with the longitudinal axis located through the center of the bolt holes 56 traveling through the center of the sleeve 62. The threaded portion 60 may then be inserted through one of the bolt holes 56 toward the other bolt hole 56 in the opposite upright wall 52. As the sleeve 62 is aligned with the bolt holes 56, the threaded portion 60 thereby also extends through the sleeve 62. It is important to note that the threaded portion 60 has a length greater than the sleeve 62, and is profiled such that a portion of the threaded portion 60 extends at least partially into the second hole 56. The end cap 64 may then be inserted into the opposite bolt hole 56 and be rotatably affixed to the threaded portion 60, securing the bolt 58 to the bracket 50. The threaded portion 60 should be inserted into the cover portion 62 a sufficient distance so that no threads from the threaded portion 60 are visible, but rather all the threads are obscured by the sleeve 62 and the cover portion 64. The fully assembled bolt and bracket assembly 65 is shown in FIG. 3B, where a smooth surface, unimpeded by the threads is positioned and prepared for receipt of latch member 66, as described below.

While it is understood that brackets 30*p*, 32*p* and 40*p* (FIG. 2) are identical, with the exception as to their location, the brackets 34*p* are also similar to that shown in FIGS. 3A and 3B. In fact, the brackets 34*p* are identical to bracket 32 shown in FIG. 3A, with the exception that the brackets include an insert, as will be described further herein.

Figure 4:
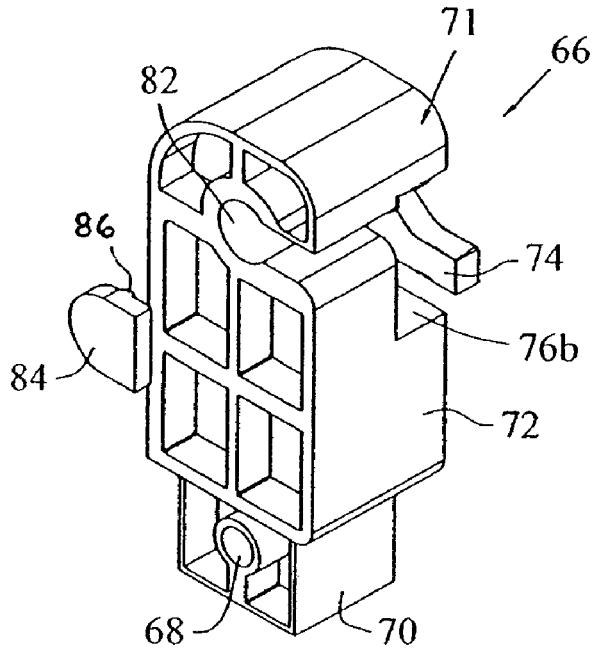
FIGS. 4 and 5 are front and rear perspective views, respectively, of the latch member of the present invention.
Figure 5:
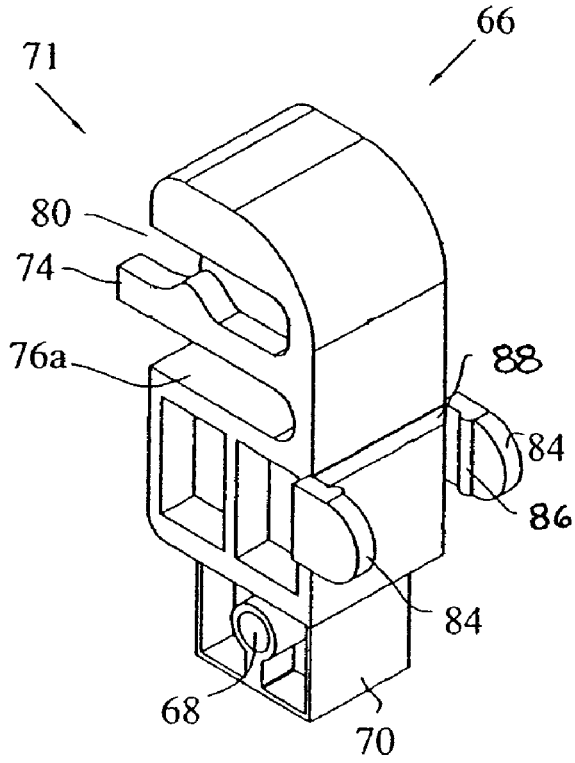
Figure 6:
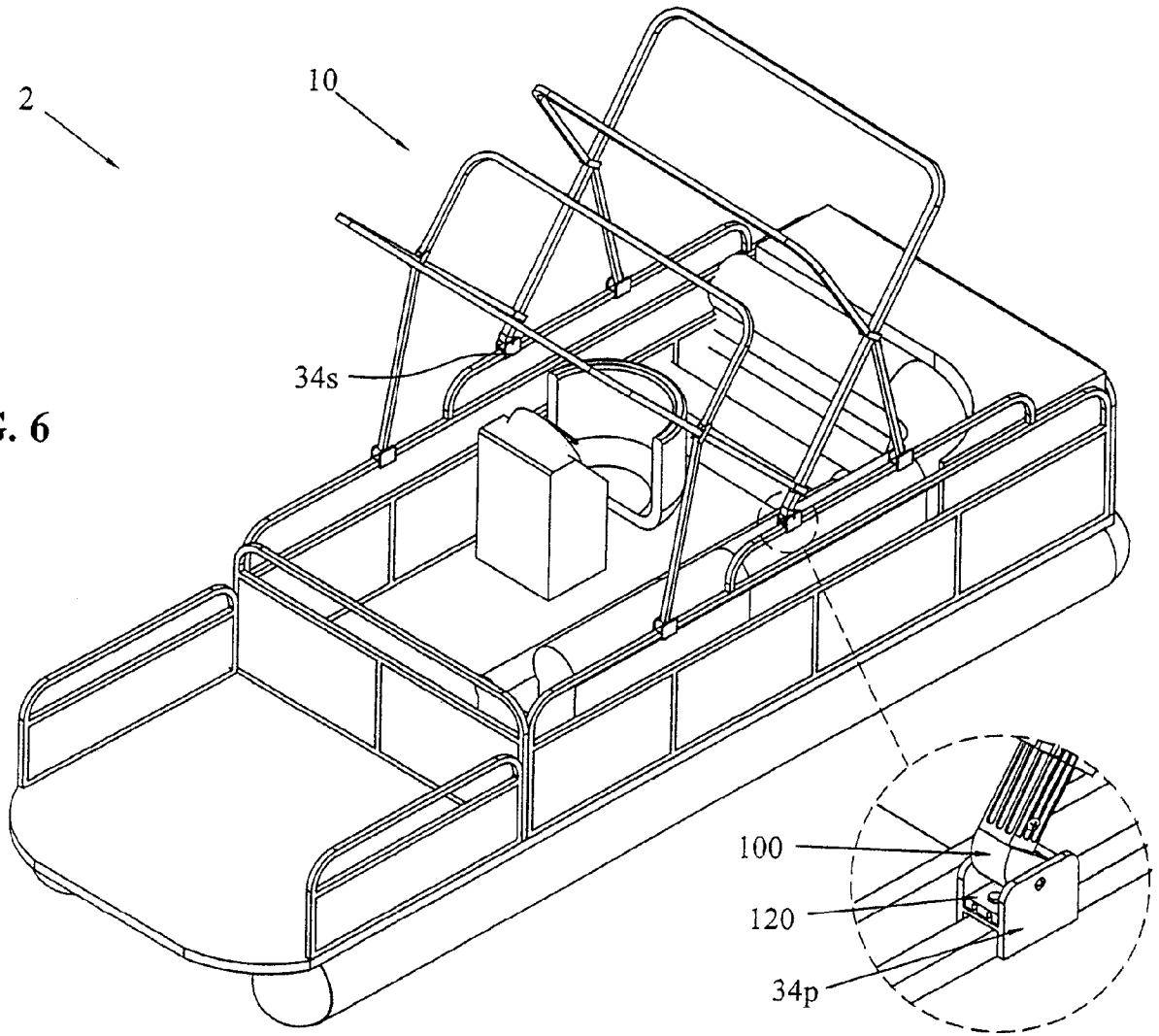
FIG. 6 depicts a perspective view of a boat showing an enlarged portion of the attachment portion of the frame.

Referring now to FIGS. 4, 5 and 6, a latching member 66 is shown. The latching member 66 is the subject of our U.S. Pat. No. 6,672,241, which is incorporated herein by reference, and will be summarized herein as it relates to the overall assembly. The latching member 66 generally includes a central body portion 72, having a latch member 71 at one end and a reduced cross-section portion 70 at the opposite end. Included within the smaller area portion 70 is a bolt hole 68 used to affix latching member 66 to a frame rail in the manner described below.

The central body portion 72 of the latching member 66 generally includes a latch arm 74, a pin-receiving slot generally indicated by numeral 80, a pin-receiving area 82 and a pair of flexible wings 84. The latch arm 74 bounds the slot 80 on one side, and is flexibly movable relative to the slot by way of relief area 76. Relief area 76 substantially surrounds the latch arm, with a horizontal relief area below latch 74 at 76A, and a vertical relief area on the inner side of latch 74 at 76B. This allows latch arm 74 to move vertically upward and downward, towards and away from the slot 80. The latch arm 74 also includes a latching boss 78 located proximate pin-receiving area 82, as shown in FIG. 6. The slot 80 and the pin-receiving area 82 are both generally greater in height than the diameter of the bolt 58, with the diameter of the bolt 58 only exceeding the height of the pivot area at the apex of the boss 78. As the boss 78 gradually slopes upward near the opening 80 but has a steep decline near the pin-receiving area 82, a bolt 58 may be slidably and transversely inserted into the opening 80, biasing latch arm 74 downwardly along the boss 78 to be retained in the pin-receiving area 82, as will be more fully described below.

As shown in FIG. 5, flexible wings 84 are shown located on the back side of the latching member 66. An alignment protrusion 88 is shown, which is represented by a raised area along the smooth back side of the latching member 66, extending between the flexible wings 84. Additionally, a wing ridge 86 can be seen on the inner surface of both of the flexible wings 84. The wing ridge 86 extends vertically the length of the flexible wing 84 and has a diameter and thickness for latching to a frame rail, as will be described herein.

FIG. 6 depicts a perspective view of a boat 2 including an enlarged portion showing bracket 34A. As is apparent from FIG. 6, the frame 10 utilizes a latch 100 in combination with bracket 34A. As can be seen in FIG. 6, the brackets 34 also include the usage of an insert 120.

Figure 7:
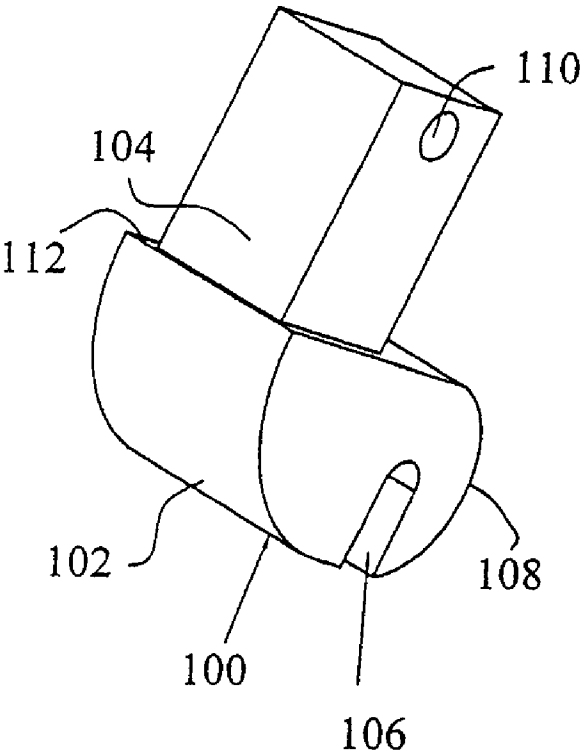
FIG. 7 depicts a perspective view of an embodiment of a rotating latching member.

Referring now to FIG. 7, a perspective view of a rotating latching member, generally indicated by numeral 100, is shown. In the embodiment depicted, rotating latching member 100 includes main body 102 and attachment portion 104 and is manufactured from a molded plastic resin. Main body 102 includes a slot 106 and an arcuate surface 108. In the present embodiment, slot 106 extends inward from the outer surface of one end of main body 102 to approximately the center thereof. Slot 106 is generally sized and configured to receive a bolt 58 described above. Furthermore, in the embodiment depicted, main body 102 also includes an arcuate surface proximate slot 106.

Referring still to FIG. 7, attachment portion 104 extends away from main body 102 from the surface opposite slot 106. Attachment portion 104 includes an aperture 110 extending therethrough. In the embodiment depicted, the outer periphery of attachment portion 104 is smaller than the outer periphery of main body 102, thereby creating a land 112 on main body 102.

Figure 8:
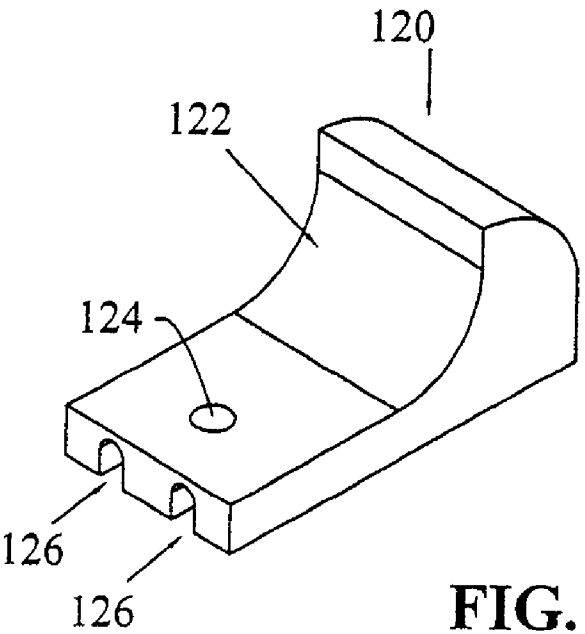
FIG. 8 depicts a perspective view of an insert used in conjunction with the rotating latching member illustrated in FIG. 7.

FIG. 8 shows a perspective view of an insert generally indicated by numeral 120. In the present embodiment, the insert 120 may be molded in a manner similar to latching member 100. Insert 120 includes an arcuate surface generally indicated by numeral 122, an aperture 124 and longitudinal slots 126. Arcuate surface 122 has a shape complementary to the arcuate surface 108 of latching member 100. Aperture 124 has a size approximately equal to that of mounting holes 54 (depicted in FIG. 3A) and extends entirely through the insert 120. In the embodiment depicted, a pair of longitudinal slots 126 flank the aperture 124 and extend the length of the insert 120.

The longitudinal slots 126 provide a means for organizing wires associated with the bimini top (not shown) connected to frame 10. For example, some types of bimini tops include lights electrically controlled by a switch located at the helm. Wires connect the lights to the switch, while the slots 126 provide a means for organizing the wires.

Figure 9:
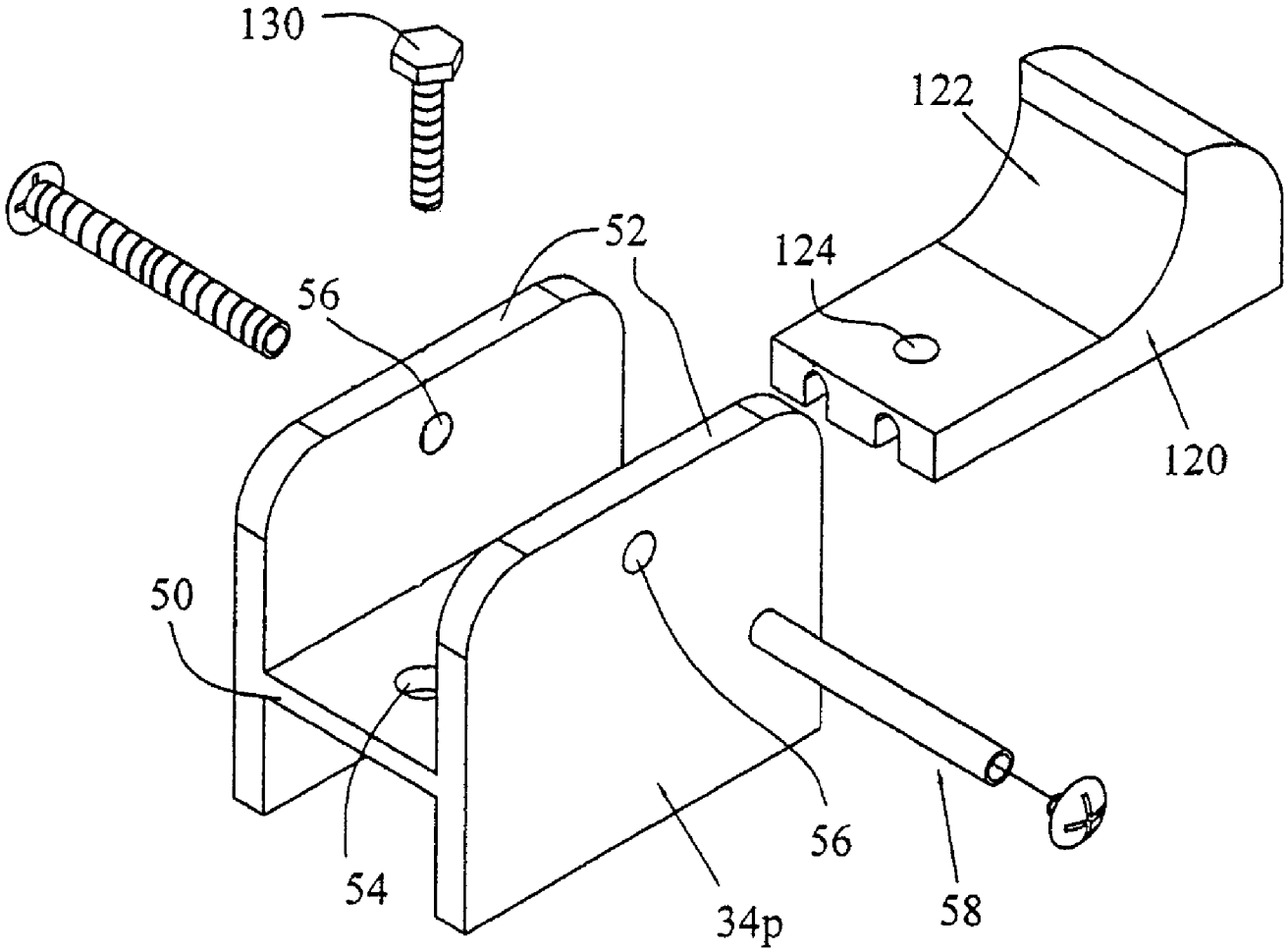
FIG. 9 depicts an exploded perspective view of an assembly comprising a bracket and insert illustrated in FIG. 8.

FIG. 9 depicts an exploded perspective view of a bracket 34 including insert 120. As can be seen in FIG. 9, insert 120 has a width smaller than the distance separating the walls 52 of bracket 34, thereby allowing insert 120 to be located intermediate the walls 52. A bolt 130 extends through aperture 124 and mounting hole 54, thereby affixing insert 120 to bracket 34. In doing so, bolt 130 also extends into a frame rail (not shown) upon which the bracket 34 will be mounted, also fixing the bracket to the rail. After the combination of the bracket 34 and insert 120 have been mounted to a frame rail via bolt 130, bolt 58 may then be attached to bracket 34 in the manner described above.

Figure 10:
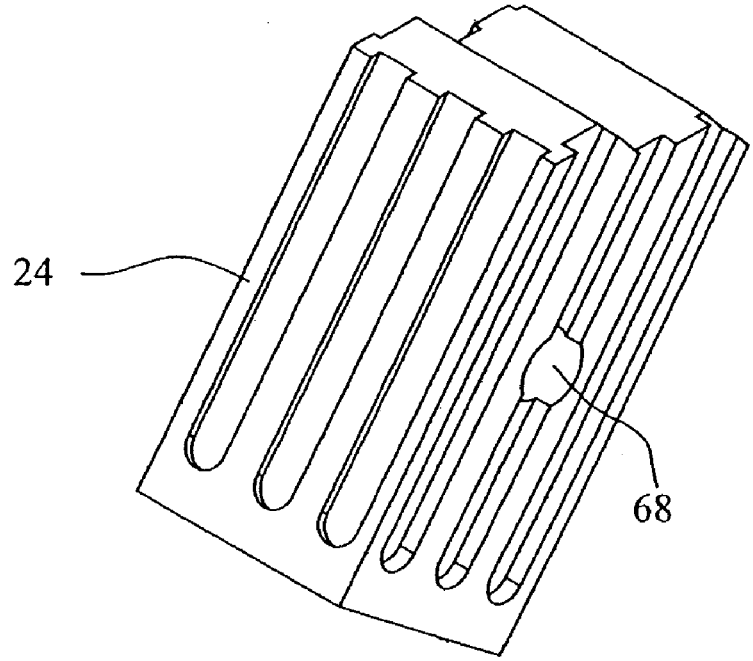
FIG. 10 depicts an assembly comprising a frame rail and the rotating latching member illustrated in FIG. 7.
Figure 10:
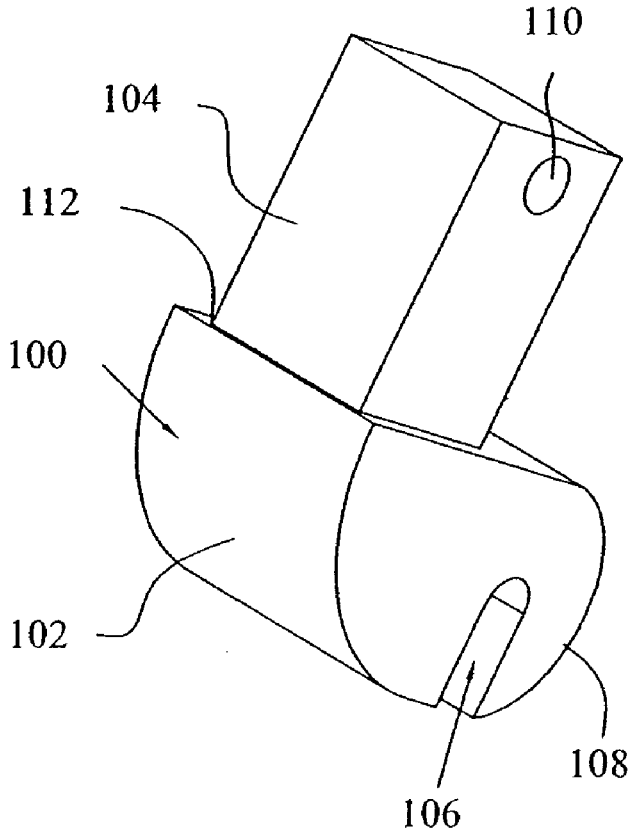

FIG. 10 depicts a perspective view of rotating latch member 100 prior to its insertion into frame rail 24. In the present embodiment, rotating latch member 100 may be attached to frame rail 24 by the insertion of the attachment portion 104 into frame 24 until frame 24 contacts land 112. When frame rail 24 contacts land 112, aperture 110 mates with bolt hole 68. A fastener (not shown) can then be employed to fasten rotating latch member 100 to frame rail 24. In the embodiment depicted, attachment portion 104 is specifically sized to reduce the "play" between the frame rail 24 and the rotating latch member 100 after the attachment portion 104 has been inserted into the frame rail 24.

Figure 11A:
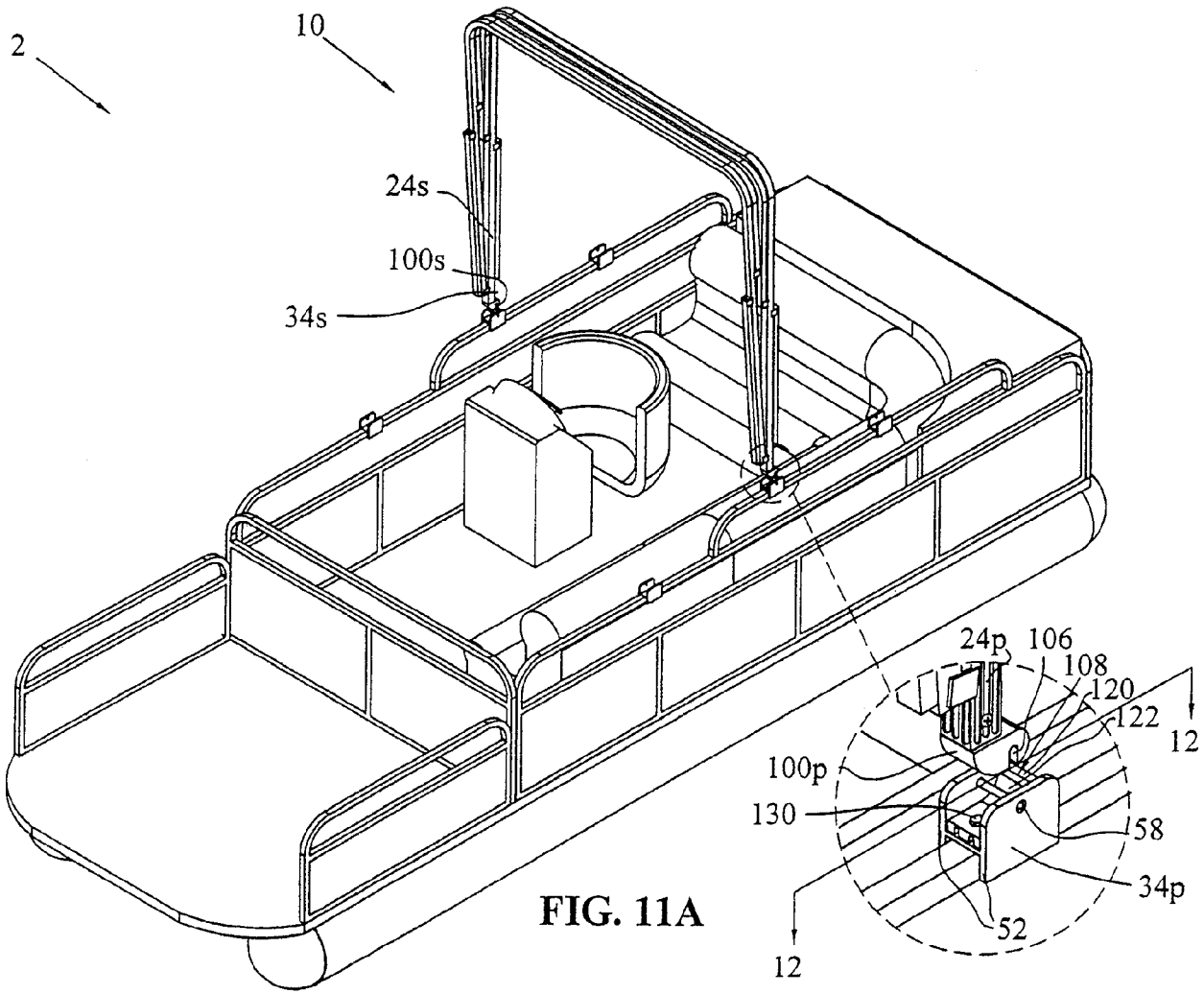
FIGS. 11A-11B illustrate one manner in which rotating latching members may connect a frame to a boat.
Figure 11B:
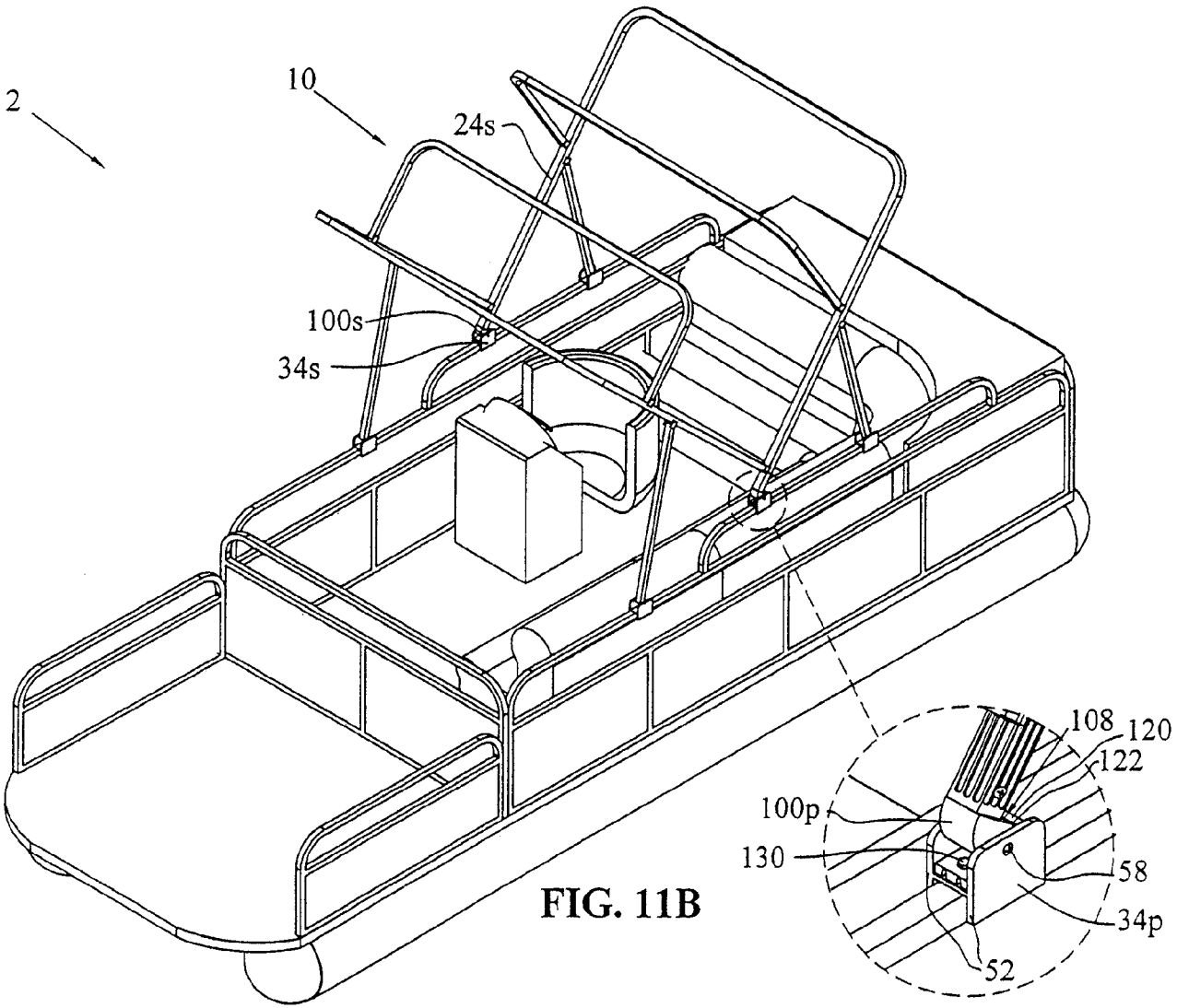
Figure 12C:
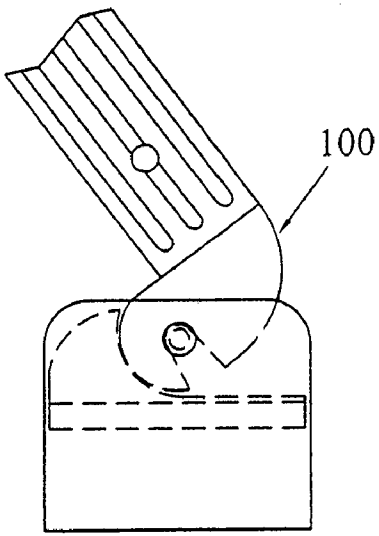
FIGS. 12A-12C illustrate cross-sectional views through lines 12-12 of FIG. 20A.
Figure 12B:
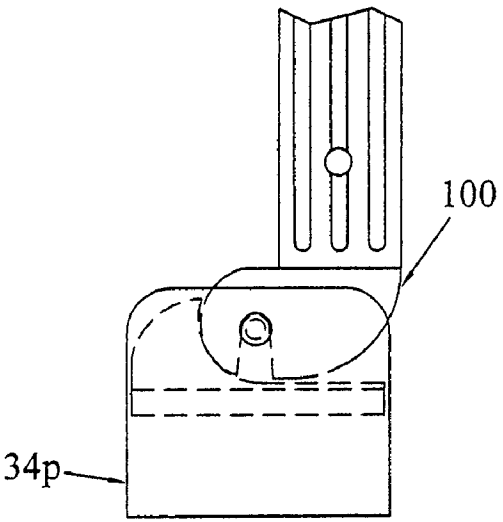
Figure 12A:
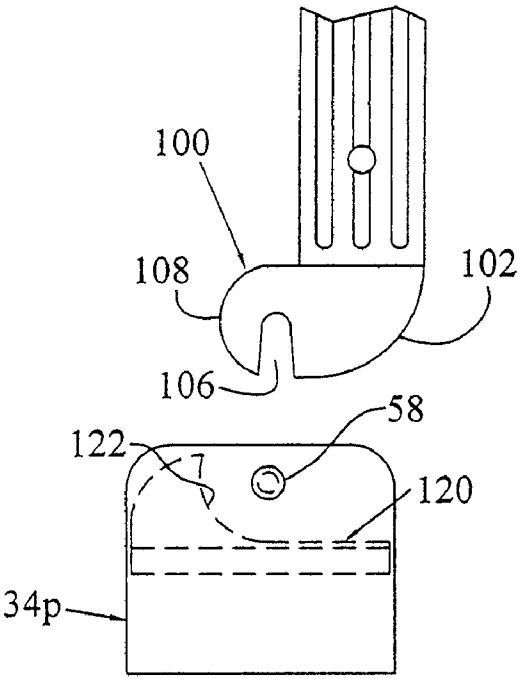

FIGS. 11A and 11B together with FIGS. 12A-12C illustrate the attachment of frame 10 to boat 2 via latching members 100. Specifically, FIG. 11A depicts the insertion of a rotating latch member 100 between the walls 52 of a bracket 34. For example, as rotating latch member 200*p* is inserted into bracket 34*p*, slot 106 receives bolt 58. It should be noted, a similar situation results on the starboard side of boat 2 between bracket 34*s* and member 100*s*. In the embodiment depicted, frame rail 24 is located substantially vertical. Slot 106 also extends substantially vertically, parallel to rail 24.

Once member 100 has been fully inserted into bracket 34 and slot 106 has fully received bolt 58 as shown in FIG. 12B, frame 24 is then rotated rearward toward the arcuate surface 122 of insert 120, as depicted in FIGS. 11B and 12C. This "over-the-center" rotation couples the rotating latch members 100 to the brackets 34. Specifically, the orientation of slot 106 in this position causes contact between the arcuate surface 108 of rotating latch member 100 and the arcuate surface 122 of the insert 120 if one were to attempt to separate the rotating latch members 100 from bolt 58.

In order to remove the frame 10 from boat 2, frame 10 would be rotated in the direction opposite that described above, thereby orientating slot 106 vertically. Once slot 106 is vertically orientated, the rotating latch members 100 may be removed from the brackets 34 without contact between the arcuate surfaces 108, 122 thereof. Thus, it should be appreciated that the bimini top frame 10 may be installed and removed from the boat 2 without removing any fasteners. Rather, the bimini top is installed through the use of latch members 100, and latched in the upright position by way of latches 66.

While this invention has been described as having an exemplary design, the present invention may be further modified within the spirit and scope of this disclosure. The application is, therefore, intended to cover any variations, uses, or adaptations of the invention using its general principles. Further, this application is intended to cover such departures from the present disclosure as come within known or customary practice in the art to which this invention pertains.

The invention claimed is:

1. A latching member for connecting a boat cover frame to a boat comprising:

an attachment portion connected to said frame; and an engagement portion including a slot;

wherein said latching member engagement portion rotates relative to a bracket on the boat until the latching member engagement portion is in an over-the-center engagement.

2. The latching member as set forth in claim 1, wherein said attachment portion includes an aperture for receiving a fastener that attaches said latching member to said frame.

3. The latching member as set forth in claim 1, wherein said latching member is coupled to said bracket following the rotation of said attachment portion over said engagement portion in an over-the-center manner.

4. The latching member as set forth in claim 1, wherein said engagement portion further includes a pivot area and an opening sized to receive a pivot pin connected to said bracket, said opening sized to allow said pivot pin to pass through, said slot connecting said opening to said pivot area.

5. The latching member as set forth in claim 4, wherein said latching member pivots about said pivot pin when rotating into said over-the-center engagement.

6. The latching member as set forth in claim 1, wherein said bracket includes at least one channel for retaining at least one electronic component.

7. The latching member as set forth in claim 6, wherein said engagement portion includes an arcuate portion contacting said bracket when said latching member rotates into said over-the-center engagement.

8. The latching member as set forth in claim 7, wherein said bracket includes an arcuate surface that complements said arcuate portion of said engagement portion.

9. The latching member as set forth in claim 8, wherein said bracket includes an insert comprising said at least one channel and said arcuate surface.

10. A mechanism for quickly connecting a boat cover frame to a boat comprising:

a latching member affixed to said boat cover frame; and a bracket affixed to said boat;

the latching member being rotatable relative to the bracket about a centerline within the bracket and having cooperative surfaces interengaging when rotated, said interengaging surfaces allowing rotational movement about the centerline, and preventing radial movement of the latching member relative to the centerline;

wherein said latching member couples to said bracket after rotating said latching member over said bracket.

11. The mechanism as set forth in claim 10, wherein said latching member includes an attachment portion connected to said boat cover frame and an engagement portion that couples to said bracket.

12. The mechanism as set forth in claim 11, wherein said engagement portion of said latching member includes an arcuate portion and said bracket includes an arcuate surface; said arcuate portion having a profile complementary to said arcuate surface.

13. The mechanism as set forth in claim 11, wherein said engagement portion includes a pivot area and said bracket includes a pivot pin, said pivot pin being disposed within said pivot area when said latching member is connected to said bracket.

14. The mechanism as set forth in claim 13, wherein said engagement portion further includes a slot and an opening, said slot connecting said opening to said pivot area and said opening is sized to allow said pivot pin to pass into said slot, said interengaging surfaces defined by said pivot pin and said slot.

15. The mechanism as set forth in claim 10, wherein said bracket includes at least one channel for receiving an electronic component.

16. The mechanism as set forth in claim 15, wherein said bracket includes an insert comprising said at least one channel and an arcuate surface.

17. The mechanism as set forth in claim 10, wherein said attachment portion is coupled to said engagement portion at a position opposite said opening.

18. A latching member for connecting a boat cover frame to a boat comprising:

an attachment portion that attaches said latching member to the frame; and an engagement portion including a slot; the engagement member being rotatable relative to the frame about a centerline, the engagement member being rotated into a locked position to the frame where radial movement relative to the centerline is prevented.

19. The latching member as set forth in claim 18, further comprising a bracket wherein said latching member is coupled to said bracket following the rotation of said attachment portion over said engagement portion in an over-the-center manner.

20. The latching member as set forth in claim 18, wherein said engagement portion further includes a pivot area and an opening sized to receive a pivot pin connected to said bracket, said opening sized to allow said pivot pin to pass through, said slot connecting said opening to said pivot area.

21. The latching member as set forth in claim 20, wherein said latching member pivots about said pivot pin when rotating into said over-the-center engagement.

22. The latching member as set forth in claim 18, wherein said bracket includes at least one channel for retaining at least one electronic component.

23. The latching member as set forth in claim 22, wherein said engagement portion includes an arcuate portion contacting said bracket when said latching member rotates into said over-the-center engagement.

24. The latching member as set forth in claim 23, wherein said bracket includes an arcuate surface that complements said arcuate portion of said engagement portion.

25. The latching member as set forth in claim 24, wherein said bracket includes an insert comprising said at least one channel and said arcuate surface.

* * * * *